US007926423B2

(12) United States Patent
Rickman et al.

(10) Patent No.: US 7,926,423 B2
(45) Date of Patent: Apr. 19, 2011

(54) SINGLE-STEP CONTACT EXPLOSIVE DEVICE FOR BREACHING REINFORCED WALLS AND METHOD OF USE THEREFOR

(75) Inventors: Denis D. Rickman, Clinton, MS (US); Jon E. Windham, Vicksburg, MS (US); John Q. Ehrgott, Jr., Vicksburg, MS (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 57 days.

(21) Appl. No.: 12/271,583

(22) Filed: Nov. 14, 2008

(65) Prior Publication Data

US 2010/0122639 A1 May 20, 2010

(51) Int. Cl.
*F42B 3/00* (2006.01)

(52) U.S. Cl. ..... 102/314; 102/331; 102/308

(58) Field of Classification Search ..... 102/306, 102/307, 308, 310, 314, 320, 321, 331, 332
See application file for complete search history.

(56) References Cited

U.S. PATENT DOCUMENTS

| | | | | | |
|---|---|---|---|---|---|
| 3,477,372 | A | * | 11/1969 | Nelson et al. | 102/307 |
| 3,658,006 | A | * | 4/1972 | Nistler et al. | 102/307 |
| 4,408,535 | A | * | 10/1983 | Alford | 102/305 |
| 4,493,260 | A | | 1/1985 | Foster | |
| 4,499,828 | A | | 2/1985 | Honodel | |
| 4,856,430 | A | | 8/1989 | Gibb et al. | |
| 4,905,601 | A | | 3/1990 | Gabriel et al. | |
| H913 | H | | 5/1991 | Hershkowitz | |
| 5,377,594 | A | | 1/1995 | Alford | |
| 5,415,101 | A | | 5/1995 | Brinkman | |
| 5,524,546 | A | | 6/1996 | Rozner et al. | |
| 6,477,959 | B1 | | 11/2002 | Ritman | |
| 6,494,139 | B1 | | 12/2002 | Powell | |
| 6,644,205 | B2 | | 11/2003 | Ritman et al. | |
| 6,758,143 | B2 | | 7/2004 | Ritman et al. | |
| 7,000,545 | B2 | | 2/2006 | Sansolo | |
| 7,284,490 | B1 | * | 10/2007 | Mutascio | 102/474 |
| 7,337,703 | B2 | | 3/2008 | Sansolo | |
| 7,472,652 | B1 | * | 1/2009 | Scheid | 102/331 |
| 2005/0126420 | A1 | | 6/2005 | Givens et al. | |
| 2009/0133597 | A1 | * | 5/2009 | Moore | 102/331 |

* cited by examiner

*Primary Examiner* — James S Bergin
(74) *Attorney, Agent, or Firm* — Earl H. Baugher, Jr.

(57) ABSTRACT

A lightweight man-packable system for breaching in a single application reinforced structure such as steel reinforced concrete (SRC) walls. Embodiments comprise two explosive charge arrays installed in a housing that is abutted against a wall using either studs or prop sticks. One embodiment positions a secondary linear shaped charge (LSC) or self-forming fragment charge (SFF) spaced apart from a primary high explosive (HE) charge that contacts the structure. The HE is detonated to remove concrete in a pattern sufficient to enable a human to transit the resultant opening and the secondary charge cuts the reinforcement shortly thereafter enabling a "clean" breach via a single application of the system. In select embodiments the second array is positioned on a hinged frame to increase stand-off from the first array and moves into place to detonate over the opening immediately after detonation of the first array.

20 Claims, 3 Drawing Sheets

SINGLE-STEP CONTACT EXPLOSIVE DEVICE FOR BREACHING REINFORCED WALLS AND METHOD OF USE THEREFOR

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees. Please contact Phillip Stewart at 601 634-4113.

BACKGROUND

Soldiers conducting military operations have a need to gain entry into reinforced buildings and through reinforced walls. Conventionally, this is done by breaching a hole that is sufficiently large for a man to crawl through, i.e., approximately 30 to 40 inches in diameter. Typical reinforced walls are constructed of concrete and feature two layers of half-inch diameter steel reinforcement (rebar) on a 12-inch grid.

Prior art addressed explosive wall-breaching. Prior art employs either a high-explosive charge placed on the wall or a series of linear shaped charges (LSC) or explosively-formed fragments (EFF) placed in close proximity thereto. High-explosives placed in contact with a steel reinforced concrete (SRC) wall are very effective in removing concrete, but the rebar remains virtually undamaged. LSC and EFF charge arrays are very effective in cutting exposed steel members, such as rebar, but are relatively ineffective against concrete unless large (heavy) charge weights are employed. Prior art does not provide the combined effects of a high-explosive charge to remove concrete and an array of LSC or EFF to cut resultant exposed rebar in one application of a lightweight device suitable for ready carry by personnel or small robots.

Prior art includes: U.S. Pat. No. 4,493,260, Annular Shaped Charge for Breaching Masonry Walls, to Foster; U.S. Pat. No. 4,499,828, Barrier Breaching Device, to Honodel; U.S. Pat. No. 4,856,430, Wall Breaching Apparatus, to Gibb et al.; U.S. Pat. No. 6,477,959, Wall Breaching Warhead, to Ritman et al.; and United States patent application, publication no. 2005/0126420 A1, Wall Breaching Apparatus and Method, to Givens et al.

The '959, '828 and '260 patents describe methods and devices for breaching non-reinforced masonry-type walls only. These do not have capacity to produce a clear breach opening through SRC walls. The '430 patent facilitates breaching a thick wall, but does not have the capacity to breach SRC walls. One embodiment of the '420 patent application permits breaching reinforced walls, but weighs "typically less than about 60 pounds" and "includes the steps of providing a metal lined linear shaped charge having a weight of less than about 60 pounds." Modern military doctrine limits "man-portable" devices to a weight of not more than about 35 pounds. Further, the '420 device states that "the metal jet cuts at least about 10% to 75% of the cut reinforcement at one location and the remainder at two locations." Practical experience has shown that this performance will not, in most cases, provide sufficient cutting of steel reinforcement to allow personnel ready access through the resultant opening. In addition, location of the reinforcement cuts resultant from employment of the '420 device is not specified. The optimal location for such cuts is near the perimeter of the resultant opening so as to maximize the size of the opening.

As noted above, conventional methods of breaching such walls with "man-packable" (lightweight) explosives employ two separate operations: placement and detonation of an explosive charge on the wall to remove the concrete, followed by a second operation to cut the exposed steel reinforcement. Cutting of the steel reinforcement is accomplished either by placing additional explosive charges directly on the exposed steel reinforcement at numerous locations to cut the individual steel reinforcement, or by shooting the individual steel reinforcements using a rifle equipped with a special adapter which allows the end of the rifle to be placed against the steel reinforcement to be cut. Either method requires soldiers, or possibly robots, to perform breaching operations at the wall twice, essentially doubling exposure. In addition, these methods do not allow access through the wall immediately after the initial explosive detonation. Thus, the element of surprise is lost in pressing an attack through the opening. The additional time required for the steel reinforcement-cutting operation also provides hostiles time to recover from blast effects of the initial detonation. Thus, a need exists for cleanly breeching a reinforced wall with but a single action on the part of personnel or robots.

DETAILED DESCRIPTION

Figure 1:
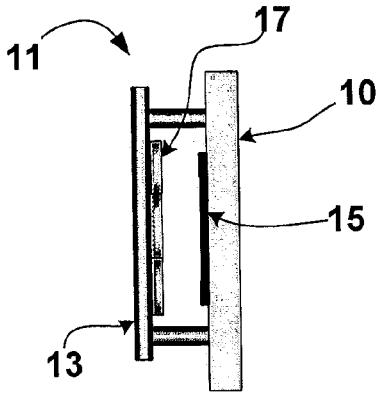
FIG. 1 is a profile of an embodiment of the present invention comprising a simple hinged or fold-out frame holding two distinctly different explosive charges set to be detonated consecutively after placement on an SRC wall.

Select embodiments of the present invention envision a device capable of breaching a "cleared" opening in a steel-reinforced concrete (SRC) wall via a single application of the device to the SRC wall. SRC walls may be of a construction typically encountered by soldiers during urban operations. Thein and Coltharp published design criteria for a "typical" SRC wall. Thein, B. K. and D. R. Coltharp, *Interim Standards for the Construction of MOBA Structures for Weapons Effects Tests*, Technical Memorandum 30-78, US Army Human Engineering Laboratory, Aberdeen Proving Ground, Md., 1978. A typical SRC wall features two layers of half-inch diameter steel reinforcement (rebar) on a 12-inch grid. A "man-sized" opening of approximately 30 to 40 inches in diameter allows an equipped soldier to readily transit. The opening produced by select embodiments of the present invention is free of concrete and rebar, thus allowing soldiers in full combat gear to readily enter through the resultant opening.

Select embodiments of the present invention include a system for at least breaching structure incorporating reinforcement, thus permitting ready access through the structure by personnel and equipment. Select embodiments of the present invention comprise: a holding fixture; one or more first explosive charge arrays mounted in the fixture such that the first explosive charge array is mounted in the fixture to be immediately adjacent the structure, and such that detonation of the first explosive charge array removes some structural material from the structure in a pre-specified shape; one or more second explosive charges mounted in the fixture such that the second explosive charge array is spaced apart a first pre-specified distance from the first explosive charge so as to be positioned a second pre-specified distance from the structure and such that detonation of the second explosive charge array removes at least some of the reinforcement exposed via detonation of the first explosive charge array; one or more initiators for detonating the first and second explosive arrays; and support to position and hold the fixture incorporating the first and second explosive charge arrays against the structure, such that detonation of the first and second charge arrays at least creates an opening for ready transit by at least personnel and equipment, and such that the system operates to clear the opening by affixing the system to the structure in a single operation.

In select embodiments of the present invention, the first explosive charge array comprises at least in part high explosive (HE).

In select embodiments of the present invention the first explosive charge array may be arranged in a shape selected from the group consisting of: polygons, squares, rectangles, circles, semi-circles, and combinations thereof.

In select embodiments of the present invention, the second explosive charge array comprises one or more linear-shaped charges (LSC).

In select embodiments of the present invention, the second explosive charge array comprises one or more self-forming fragment (SFF) charges.

In select embodiments of the present invention the second explosive charge array is fixably positioned on a frame incorporated in the fixture behind the first explosive charge array.

In select embodiments of the present invention the frame comprises a polyhedron for its outer perimeter.

In select embodiments of the present invention the second explosive charge array is arranged on the frame in contact with the outer perimeter in a shape selected from the group consisting of: polygons, rectangles, squares, circles, linear bars, and combinations thereof.

In select embodiments of the present invention the fixture comprises at least in part aluminum.

In select embodiments of the present invention the second explosive charge array is affixed to a frame hinged to the fixture.

In select embodiments of the present invention the system comprises a device, such as a tensioning device that may be a compression spring element, that both permits the second explosive charge array to initially be positioned off-axis from the first explosive charge array and to also immediately relocate to adjacent the opening upon detonation of the first explosive charge array, such that the second explosive charge array is positioned off-axis from the first explosive charge array upon installation of the system for use on the structure.

In select embodiments of the present invention the support comprises one or more studs.

In select embodiments of the present invention the support comprises one or more prop sticks.

In select embodiments of the present invention the fixture is incorporated in a lightweight housing.

In select embodiments of the present invention the system comprises gravitational support connected to the housing, such that the gravitational support contacts a surface adjacent the structure that is supported by the earth.

Select embodiments of the present invention comprise a system that clears an opening through a steel reinforced concrete (SRC) wall incorporating steel reinforcement, the opening sufficiently large for a human to transit. Select embodiments of the present invention comprise: a holding fixture; one or more first explosive charge arrays mounted in the fixture, such that the first explosive charge array is mounted in the fixture to fit immediately adjacent the wall upon installation thereto, and such that detonation of the first explosive charge array removes concrete in a pre-specified shape; one or more second explosive charge arrays mounted in the fixture, such that the second explosive charge array is spaced apart a first pre-specified distance from a first explosive charge so as to be positioned a second pre-specified distance from the wall; and such that detonation of the second explosive charge array removes some steel reinforcement exposed via detonation of the first explosive charge; one or more initiators for detonating the first and second explosive charge arrays; and support to position and hold the fixture incorporating the first and second explosive charge arrays against the wall, such that detonation of the first and second charge arrays creates an opening for ready transit by a human, and such that the system operates to clear the opening by affixing the system to the wall in a single operation.

Select embodiments of the present invention provide a method for breaching structure incorporating reinforcement, thus permitting ready access through the structure by personnel and equipment. The method comprises: providing a holding fixture; mounting one or more first explosive charge arrays in the fixture, such that the first explosive charge array is mounted in the fixture to be immediately adjacent the structure, and such that detonation of the first explosive charge array removes structural material from the structure and exposes the reinforcement where the structural material has been removed; mounting one or more second explosive charge arrays in the fixture, such that the second explosive charge array is spaced apart a first pre-specified distance from the first explosive charge array so as to be positioned a second pre-specified distance from the structure, and such that detonation of the second explosive charge array removes reinforcement exposed via detonation of the first explosive charge array; providing one or more initiators in operable communication with the first and second explosive charge arrays, the initiators for detonating the first and second explosive arrays, respectively; providing support to position and hold the fixture incorporating the first and second explosive charge arrays against the structure, positioning the fixture immediately adjacent the structure in a single operation; and activating the initiator to detonate the first and second explosive charge arrays, such that detonation of the first and second explosive charge arrays creates an opening for ready transit by personnel and equipment.

In select embodiments of the present invention the method further comprises: providing the fixture with a hinged frame for holding the second explosive charge array, such that the hinged frame permits the second explosive charge array to be folded away from the first explosive charge array upon placement of the system on the structure; and positioning the second explosive charge array over the opening immediately after detonation of the first explosive charge array, such that the positioning permits the second explosive charge array to detonate immediately adjacent the exposed reinforcement.

Select embodiments of the present invention comprise initiating detonation of the first and second explosive charge arrays simultaneously. Select embodiments of the present invention comprise initiating detonation of the first explosive charge array before initiation of the second explosive charge array.

Other applications for select embodiments of the present invention include "one-step" (one application) breaching of various wall types (such as reinforced and un-reinforced concrete masonry walls, clay brick walls, adobe block walls and the like) and cutting of reinforced concrete columns or pillars.

Select embodiments of the present invention comprise two explosive charge arrays, hinged or "folded" to be employed consecutively in closely spaced detonations. In select embodiments of the present invention, a first configuration comprises military-grade high-explosives (HE's) arranged along a perimeter of a mounting frame. This frame may be selected from shapes comprising circular, oval, polygonal, and the like or fabricated in a thin sheet configuration. When select embodiments of the present invention are placed against an SRC wall, the first explosive array is in direct contact with the surface of the SRC wall. In select embodiments of the present invention, the second charge array comprises a series of linear shaped charges (LSC's), or self-forming fragment charges (SFF's), that are aligned parallel to the wall surface. In select embodiments of the present invention, this series (array) of charges is supported at a pre-specified distance behind the first, high-explosive charge array, at least in a storage or transport configuration prior to emplacement. In select embodiments of the present invention, the second charge array, typically LSC's or SFF's and the like, is positioned at a set location behind the first charge array (typically an HE charge). In select embodiments of the present invention the second array is positioned on a fold-out or hinged frame to increase stand-off from the first array. When positioned on a fold-out or hinged frame, the second array either falls into detonation position by force of gravity, or is propelled into position by a "tensioner," such as a spring mechanism, or may be positioned by a small explosive charge, and combinations thereof.

Select embodiments of the present invention are affixed to an SRC wall by personnel who physically carry them to the wall. Select embodiments of the present invention may also be applied via a robot.

Select embodiments of the present invention incorporate means for placing a combination of explosive charge arrays against a wall with a first HE charge array contacting the wall. Select embodiments of the present invention are attached to a wall via one or more studs. With select embodiments of the present invention the studs may be driven into the wall with a "stud driver" tool. Select embodiments of the present invention may be supported by a "prop stick" used either in combination with or instead of the studs. In select embodiments of the present invention the prop stick may incorporate multiple parts. Once attached to the wall, select embodiments of the present invention are ready to detonate. Select embodiments of the present invention are equipped with a fold-out or hinged frame that both supports and positions the secondary charge array. In select embodiments of the present invention, the secondary array is folded out to either one side or to above or below the installed first explosive charge array. In select embodiments of the present invention, the fold-out array, when used, is held in place with either a prop stick or tensioner, such as a spring. After select embodiments of the present invention are properly located on an SRC wall, personnel and equipment, as employed, withdraw to a safe distance prior to detonation. Shortly after consecutive primary and secondary detonations personnel may transit the opening created thereby.

Select embodiments of the present invention comprise providing a first explosive charge array for removing concrete from the wall, providing a second explosive charge array for cutting reinforcement in the wall, positioning the second explosive charge array behind the first explosive charge array, placing the combination of explosive charge arrays against the reinforced concrete wall with the first explosive charge array contacting the wall, detonating the first explosive charge array to breach the wall's concrete within and near the perimeter of the first explosive charge array, and detonating the second explosive charge array to produce metallic fragments that are propelled at high velocity toward exposed reinforcement, such as steel re-bar, to cut the reinforcement and produce a "cleared" opening in the wall suitable for transit by a human.

Select embodiments of the present invention allow a "one-step" breach of SRC walls, i.e., soldiers (or robots) need perform only one operation at the wall: placement of the device against the wall. This greatly reduces exposure to enemy response. After the device detonates, a cleared opening is produced, i.e., immediate access is available because the opening is "cleared." This preserves the element of surprise, allowing an immediate offensive since the hostiles may be slowed or incapacitated to some degree by the detonations.

Refer to FIG. 1, illustrating a side (edge) view of components of an embodiment 11 of the present invention as affixed to a wall 10. The device 11 comprises two explosive charge arrays 15, 17. The first array 15 is a HE charge that contacts the surface of the wall 10 and has a goal of creating an opening in the concrete itself. In select embodiments of the present invention, the first array 15 comprises military-grade HE's arranged along the perimeter of a circular, oval, or polygonal shape, or in a thin sheet configuration.

Figure 2:
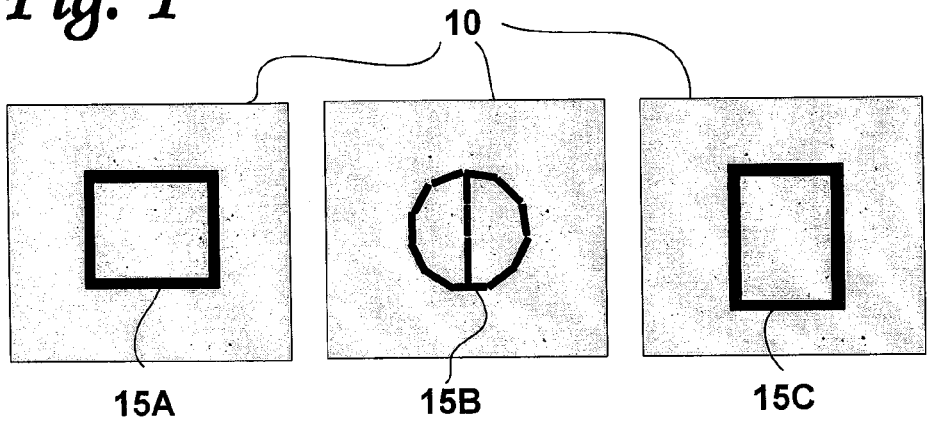
FIG. 2 depicts three variations for the geometry of the contact explosive charges that may be employed in select embodiments of the present invention.

Refer to FIG. 2, depicting some possible geometries (square 15A, split circle 15B, rectangle 15C) for the HE charge of the first array 15. An HE charge placed in contact with an SRC wall is very effective at removing concrete, but conventional steel reinforcement is unaffected.

In select embodiments of the present invention, when the device 11 is properly placed against a wall 10, the first array 15 is in direct contact with the surface of the wall 10. In select embodiments of the present invention, the second array 17, spaced apart from the wall 10 and the first array 15, comprises a secondary charge to cut steel reinforcement enclosed within the concrete removed by detonating the HE in the first array 15. The second array 17 may comprise one or more LSC's, SFF's, or both, and the like.

Figure 3:
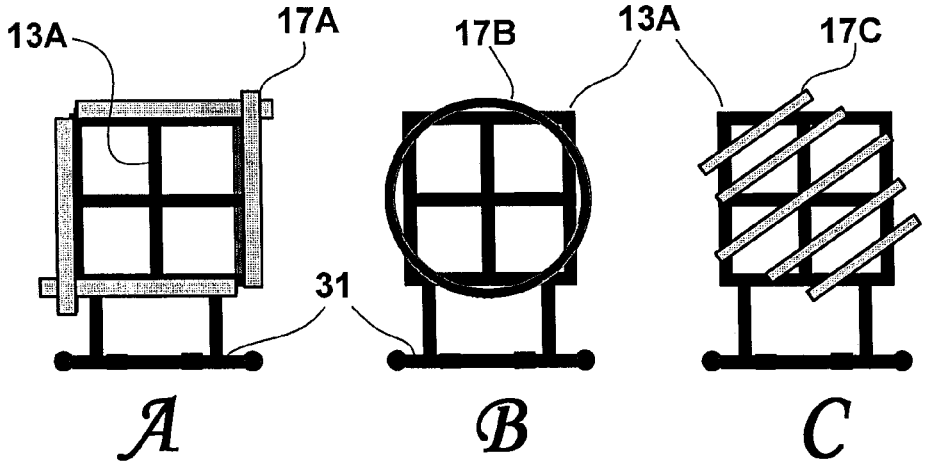
FIG. 3 depicts three variations for the geometry of the secondary charge for rebar cutting that may be employed in select embodiments of the present invention.

Refer to FIG. 3 showing possible arrangements (rectangle 17A, circle 17B, cross bars 17C) for configuring the secondary charges. LSC's and SFF's are very effective in cutting exposed steel members, such as steel reinforcement, but are relatively ineffective against concrete unless heavy charges are used.

Figure 4:
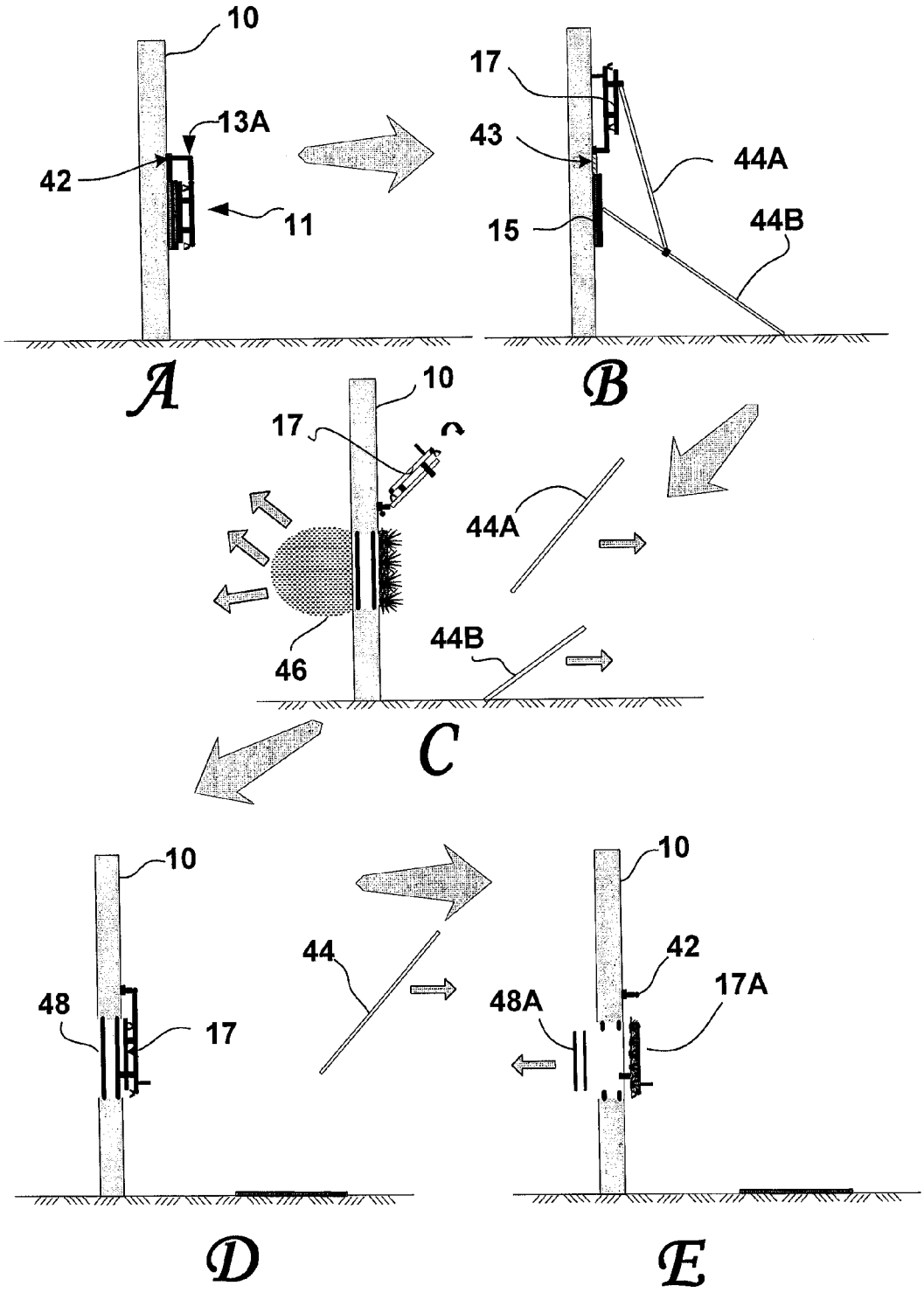
FIG. 4 illustrates the sequence of events upon placing a select embodiment of the present invention on a wall through the detonation of the secondary charge.

In select embodiments of the present invention, when the device 11 is properly placed against an SRC wall 10, the second array 17 is aligned parallel to the wall 10 and is supported on a support frame 31 (FIG. 3) at a pre-specified distance behind the first array 15 (FIG. 1). In select embodiments of the present invention, the second array 17 may be positioned at a pre-specified distance behind the first array 15, as shown in FIG. 1, or it may be positioned on a fold-out (hinged) frame 31, preferably made from aluminum and having a hinge 43 (FIG. 4) at one end. The latter (hinged) configuration enables an increase in stand-off from the first array 15. In select embodiments of the present invention from a location on a fold-out frame 31, the second array 17 falls into position from above the position of the first array 15 by force of gravity as shown in FIG. 4C. In select embodiments of the present invention the second array 17 is propelled from its initial location into position for detonation by a spring mechanism, small explosive charge, or both, and the like.

Refer to FIG. 4, illustrating a sequence of events representing a single use of select embodiments of the present invention. Select embodiments of the present invention may be employed against an SRC wall 10 by personnel or robots that physically carry the device 11 to the wall 10. The device 11 may be attached to the wall 10 by one or more mounting studs 42 that may be driven into the wall with a "stud driver" tool. The device 11 may also be supported by a "prop stick" 44, 44A, 44B used either in combination with or instead of the studs 42. Once attached to the wall 10, select embodiments of the present invention are ready to detonate. Select embodiments of the present invention equipped with a fold-out or hinged frame 13A for the secondary array 17 may require the frame 13A to be folded out to a side or to above or below the first array 15. In select embodiments of the present invention, the fold-out frame 13A, when used, may be held in place with either a prop stick 44, 44A, 44B or a tensioner (not shown separately), such as a compression spring element. After the device 11 is properly located on the wall 10, personnel and equipment, such as a robot, withdraw to a safe distance before detonation.

Again refer to FIG. 4, depicting the sequential operation of an embodiment of the present invention in A through E of FIG. 4. In the depicted device 11, the second array 17 is affixed to a fold-out or hinged frame 13A. Upon initiation of the device 11, the HE charge 15A, 15B, 15C detonates and displaces the concrete within and near the perimeter of the emplaced explosive charge array 15, thereby exposing any reinforcing steel 48 located in that portion of the wall 10. In select embodiments of the present invention the explosive material 17A, 17B, 17C in the secondary array 17, typically LSC's or SFF's and the like, is initiated simultaneously with the HE 15A, 15B, 15C of the first array 15. In select embodiments of the present invention the explosive material 17A, 17B, 17C of the secondary array 17, typically LSC's or SFF's and the like, is detonated at a slightly delayed time to produce multiple projectiles, such as metallic projectiles, that are propelled at high velocity toward any exposed reinforcement, such as steel re-bar. In select embodiments of the present invention the secondary array 17 is located on a frame 13A attached to a hinged or foldout support frame 31 positioned to the top, side or bottom of the first array 15. In select embodiments of the present invention the secondary array 17 is activated to re-position in front of the exposed reinforcement 48 immediately after detonation of the HE 15A, 15B, 15C in the first array 15. The projectiles (not shown separately) in the secondary explosive material 17A, 17B, 17C cut the steel reinforcement 48, producing a cleared opening through which personnel may transit.

Refer to FIG. 4 at A illustrating an embodiment 11 of the present invention being mounted on a wall 10 with mounting studs 42. The second array 17 (FIG. 1) is positioned behind the first array 15 (FIG. 1) with a positioning means that includes a frame 13A attached to a hinged or foldout frame 31 (FIG. 3).

FIG. 4 at B shows the embodiment 11 at A opened and the second array 17 folded out on the hinged or foldout frame 31 (FIG. 3) with plastic spacers 43 and reinforcement cutting charges 17A, 17B, 17C (FIG. 3), such as LSC's or SFF's, now positioned above the first array 15. In select embodiments of the present invention, the opened device at B is supported with prop sticks 44A, 44B.

FIG. 4 at C depicts detonation of the HE 15A, 15B, 15C of the first array 15 with the wall material 46, such as concrete, adobe, and the like, scattering inward, followed by rotation of the second array 17 downward as the prop sticks 44A, 44B are released.

FIG. 4 at D shows the second array 17 in firing position over the breached opening in the wall 10 and the exposed reinforcement 48, typically steel re-bar.

FIG. 4 at E illustrates detonation of the explosive material 17A, 17B, 17C and the instant displacement of the reinforcement 48A, typically steel reinforcement, as cut by the explosively-formed projectiles (not shown separately).

Figure 5:
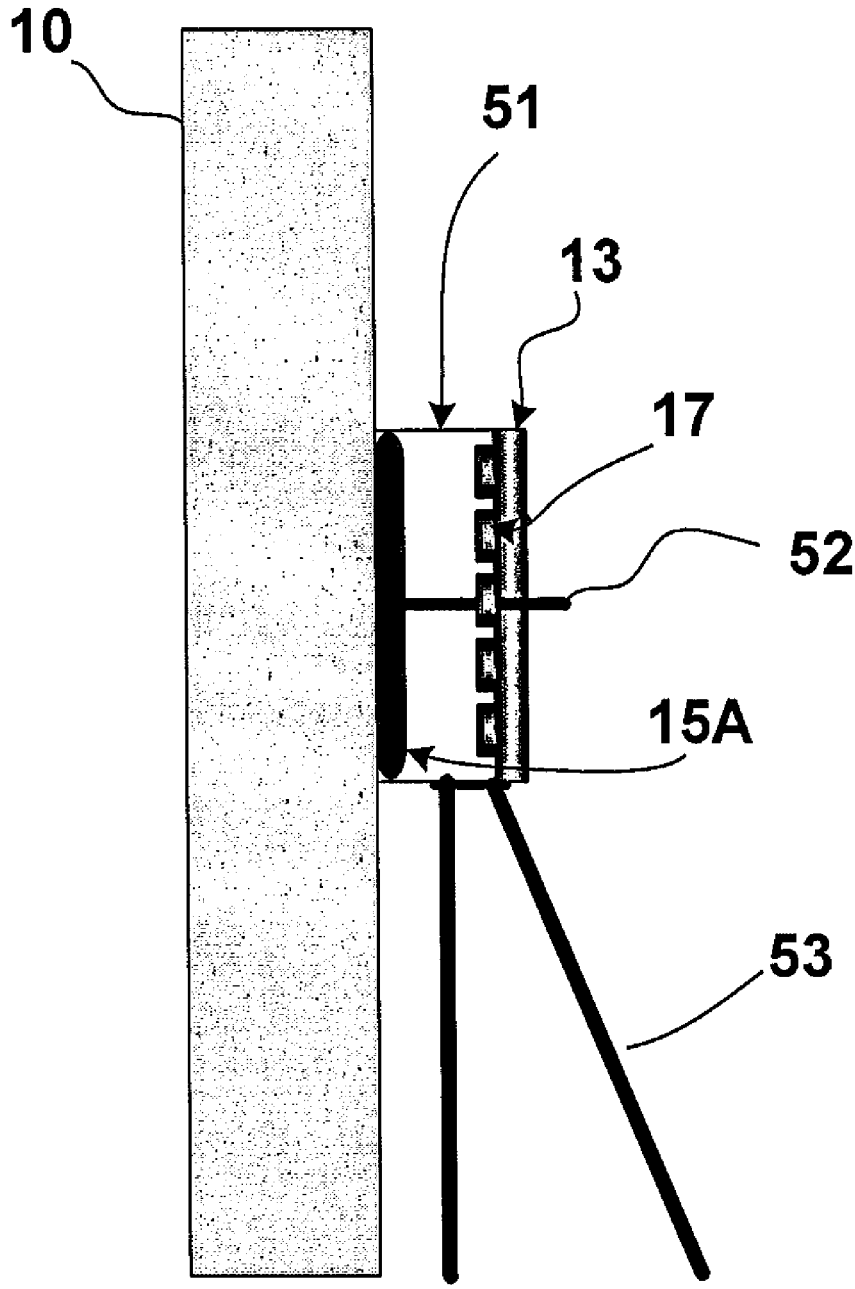
FIG. 5 shows a section on edge of an embodiment of the present invention as may be deployed on a wall just prior to use.

FIG. 5 pictures another embodiment of the present invention having a light weight housing 51 for a packaged version that may be carried by a single person or a small robot. The standard for munitions of this type is approximately 35 pounds. A support 53 positions the housing 51 enclosing a charge 15A (typically a C4 ring charge) and an array 17 incorporating explosive material (typically an LSC or SFF, or the like) against the wall 10. A frame 13 at the rear of the housing 51 positions the second array 17 behind the ring charge 15A. In select embodiments of the present invention common initiator 52 detonates the charges 15A, and the explosive material 17A, 17B, 17C in the array 17 with the HE charge against the wall 10 detonated immediately before the secondary "reinforcement cutting" charge 17A, 17B, 17C so as to clear the wall material 46 (FIG. 4C), typically concrete, from the opening prior to detonating the secondary charge 17A, 17B, 17C. In select embodiments of the present invention, the explosive material 17A, 17B, 17C of the second array 17 is initiated simultaneously with the first charge 15A to produce projectiles, typically metallic projectiles that are propelled at high-velocity toward exposed reinforcement 48, typically steel re-bar.

Select embodiments of the present invention are suitable for carry by personnel or a robot. Cutting the reinforcement 48 at the perimeter maximizes the size of the cleared opening while also facilitating manual bending of any remaining reinforcement, thereby allowing personnel ready access through the subsequent opening.

The abstract of the disclosure is provided to comply with the rules requiring an abstract that will allow a searcher to quickly ascertain the subject matter of the technical disclosure of any patent issued from this disclosure. (37 CFR §1.72 (b)). Any advantages and benefits described may not apply to all embodiments of the invention.

While the invention has been described in terms of some of its embodiments, those skilled in the art will recognize that the invention can be practiced with modifications within the spirit and scope of the appended claims. For example, although the system is described in specific examples for breaching a reinforced wall, it may be used for any type of removal of structure via shape-charge blasts and thus may be useful in such diverse applications as renovation, mining, drilling, remediating, environmental intervention, military operations and the like. Structure on which an embodiment of the present invention may be employed may be of any type ranging from naturally occurring to manmade. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Thus, it is intended that all matter contained in the foregoing description or shown in the accompanying drawings shall be interpreted as illustrative rather than limiting, and the invention should be defined only in accordance with the following claims and their equivalents.

We claim:

1. A system for at least breaching structure incorporating reinforcement, thus permitting ready access through said structure by personnel and equipment, comprising:

a holding fixture;

at least one first explosive charge array comprising high explosive (HE) to be mounted in said fixture, wherein said first explosive charge array is mounted in said fixture to be at least immediately adjacent said structure, and wherein detonation of said first explosive charge array removes at least some structural material from said structure in a pre-specified shape;

at least one second explosive charge-array comprising material selected from the group consisting of explosively formed fragments (EFF), linear shaped charges (LSC), and combinations thereof, to be mounted in said fixture, wherein said second explosive charge array is spaced apart a first pre-specified distance from said first explosive charge array so as to be positioned a second pre-specified distance from said structure; and wherein detonation of said second explosive charge array removes at least some said reinforcement exposed via detonation of said first explosive charge array;

at least one initiator for detonating said first and second explosive charge arrays; and a support to position and hold said fixture incorporating said first and second explosive charge arrays against said structure, wherein detonation of said first and second explosive charge arrays at least creates an opening for ready transit by at least said personnel and equipment, and wherein said system operates to clear said opening by adjoining said system to said structure in a single operation.

2. The system of claim 1, said at least one initiator comprising first and second initiators, said first initiator for detonating said first explosive charge array and said second initiator for detonating said second explosive charge array.

3. The system of claim 1, said first explosive charge array arranged in a shape selected from the group consisting of: polygons, squares, rectangles, circles, semi-circles, and combinations thereof.

4. The system of claim 1, said second explosive charge array comprising at least one linear-shaped charge (LSC).

5. The system of claim 1, said second explosive charge array comprising at least one self-forming fragment (SFF) charge.

6. The system of claim 1, said second explosive charge array fixably positioned on a frame incorporated in said fixture behind said first explosive charge array.

7. The system of claim 6, said frame comprising at least a polyhedron outer perimeter.

8. The system of claim 7, said second explosive charge array arranged on said frame in contact with said outer perimeter in a shape selected from the group consisting of: polygons, rectangles, squares, circles, linear bars, and combinations thereof.

9. The system of claim 1, said fixture comprising at least in part aluminum, wherein said system produces an opening in said structure at least approximately 39 inches in diameter while cutting at least 75% of said exposed reinforcement at two or more locations at least approximately 36 inches apart and cutting any remainder of said exposed reinforcement at one or more locations near the perimeter of said opening.

10. The system of claim 1, said second explosive charge array affixed to a frame hinged to said fixture.

11. The system of claim 10 further comprising a device that both permits said second explosive charge array to initially be positioned off-axis from said first explosive charge array and to immediately re-locate to adjacent said opening upon detonation of said first said explosive charge array, wherein said second explosive charge array is positioned off-axis from said first explosive-charge array upon installation of said system for use on said structure.

12. The system of claim 1 said support comprising at least one stud.

13. The system of claim 1 said support comprising at least one prop stick.

14. The system of claim 1 said fixture further comprising at least a housing.

15. The system of claim 14 further comprising gravitational support for at least said housing, wherein said gravitational support is in operable communication with at least said housing and at a surface adjacent said structure that is in operable communication with the earth.

16. A system that clears an opening through a steel reinforced concrete (SRC) wall incorporating at least some steel reinforcement, said opening sufficiently large for a human to transit, comprising:

a holding fixture;

at least one first explosive charge array comprising high explosive (HE) to be mounted in said fixture, wherein said first explosive charge array is mounted in said fixture to be at least immediately adjacent said wall, and wherein detonation of said first explosive charge array removes at least some concrete in a pre-specified shape;

at least one second explosive charge array selected from the group consisting of explosively formed fragments (EFF), linear shaped charges (LSC), and combinations thereof, to be mounted in said fixture, wherein said second explosive charge array is spaced apart a first pre-specified distance from said first explosive charge array so as to be positioned a second pre-specified distance from said wall; and wherein detonation of said second explosive charge array removes at least some said steel reinforcement exposed via detonation of said first explosive charge array;

at least one initiator for detonating said first and second explosive charge arrays; and a support to position and hold said fixture incorporating said first and second explosive charge arrays against said wall, wherein detonation of said first and second explosive charge arrays at least creates an opening for ready transit by at least said human, and wherein said system operates to clear said opening by adjoining said system to said wall in a single operation.

17. A method of at least breaching structure incorporating reinforcement, thus permitting ready access through said structure by personnel and equipment, comprising:

providing a system incorporating at least a holding fixture;

mounting at least one first explosive charge array comprising high explosive (HE) in said fixture, wherein said first explosive charge array is mounted in said fixture to be at least immediately adjacent said structure, and wherein detonation of said first explosive charge array removes at least some structural material from said structure and exposes at least some said reinforcement;

mounting at least one second explosive charge array selected from the group consisting of explosively formed fragments (EFF), linear shaped charges (LSC), and combinations thereof, in said fixture, wherein said second explosive charge array is spaced apart a first pre-specified distance from said first explosive charge array so as to be positioned a second pre-specified distance from said structure; and wherein detonation of said second explosive charge array removes at least some said reinforcement exposed via detonation of said first explosive charge array;

providing at least one initiator in operable communication with at least said first and second explosive charge arrays, said initiator for detonating said first and second explosive charge arrays; and providing a support to position and hold said fixture incorporating said first and second explosive charge arrays against said structure, positioning said system immediately adjacent said structure in a single operation; and activating said at least one initiator to detonate said first and second explosive charge arrays, wherein detonation of said first and second explosive charge arrays at least creates an opening for ready transit by at least said personnel and equipment.

18. The method of claim 17 further comprising:

providing said fixture with a hinged frame for holding said second explosive charge array, wherein said hinged frame permits said second explosive charge array to be folded away from said first explosive charge array upon placement of said system adjacent said structure; and positioning said second explosive charge array over said opening immediately after detonation of said first explosive charge array, wherein said positioning permits said second explosive charge array to detonate immediately adjacent said exposed reinforcement to remove at least some said reinforcement.

19. The method of claim 17 activating said at least one initiator to detonate said first and second explosive charge arrays simultaneously.

20. The method of claim 17 further comprising providing a first said at least one initiator in operable communication with said first explosive charge array;

providing a second said at least one initiator in operable communication with said second explosive charge array; and activating said first at least one initiator before said second at least one initiator.

* * * * *